US007638249B2

(12) United States Patent
Lin et al.

(10) Patent No.: US 7,638,249 B2
(45) Date of Patent: Dec. 29, 2009

(54) IMAGING MEMBER

(75) Inventors: Liang-bih Lin, Rochester, NY (US); Daniel V. Levy, Rochester, NY (US); Jin Wu, Webster, NY (US); John S. Chambers, Rochester, NY (US); Francisco Lopez, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 429 days.

(21) Appl. No.: 11/504,944

(22) Filed: Aug. 16, 2006

(65) Prior Publication Data

US 2007/0242979 A1 Oct. 18, 2007

Related U.S. Application Data

(63) Continuation-in-part of application No. 11/403,981, filed on Apr. 13, 2006.

(51) Int. Cl.
*G03G 5/14* (2006.01)

(52) U.S. Cl. ..... 430/60; 430/65; 430/131; 399/159

(58) Field of Classification Search ..... 430/60, 430/131, 63, 65; 399/159; 523/200
See application file for complete search history.

(56) References Cited

U.S. PATENT DOCUMENTS

| | | | | |
|---|---|---|---|---|
| 4,464,450 | A | 8/1984 | Teuscher | |
| 4,518,669 | A | 5/1985 | Yashiki | |
| 4,579,801 | A | 4/1986 | Yashiki | |
| 4,775,605 | A | 10/1988 | Seki et al. | |
| 4,871,635 | A * | 10/1989 | Seki et al. | 430/60 |
| 5,017,449 | A | 5/1991 | Yoshihara | |
| 5,344,734 | A | 9/1994 | Monbaliu et al. | |
| 5,385,798 | A | 1/1995 | Spiewak et al. | |
| 5,449,573 | A | 9/1995 | Aoki et al. | |
| 5,489,496 | A | 2/1996 | Katayama et al. | |
| 5,595,847 | A * | 1/1997 | Nogami et al. | 430/64 |
| 5,641,599 | A | 6/1997 | Markovics et al. | |
| 5,656,407 | A | 8/1997 | Kawahara | |
| 5,721,080 | A | 2/1998 | Terrell et al. | |
| 5,928,824 | A | 7/1999 | Obinata et al. | |
| 5,932,385 | A * | 8/1999 | Takamura et al. | 430/63 |
| 6,180,309 | B1 | 1/2001 | Maty et al. | |
| 6,200,716 | B1 | 3/2001 | Fuller et al. | |
| 6,207,334 | B1 | 3/2001 | Dinh et al. | |
| 7,312,007 | B2 | 12/2007 | Lin et al. | |
| 2003/0224268 | A1 * | 12/2003 | Ikuno et al. | 430/66 |
| 2003/0232265 | A1 * | 12/2003 | Yamanami et al. | 430/65 |
| 2006/0057480 | A1 * | 3/2006 | Lin et al. | 430/65 |
| 2007/0178396 | A1 * | 8/2007 | Wu et al. | 430/69 |

OTHER PUBLICATIONS

Amino Coating Resins, DIC Corporation, <http://www.dic.co.jp/en/products/coating/amino/index.html>, retrieved Jun. 29, 2009.*

* cited by examiner

*Primary Examiner*—Christopher RoDee
(74) *Attorney, Agent, or Firm*—Pillsbury Winthrop Shaw Pittman LLP

(57) ABSTRACT

The presently disclosed embodiments relate in general to electrophotographic imaging members, such as layered photoreceptor structures, and processes for making and using the same. More particularly, the embodiments pertain to a photoreceptor undercoat layer that includes a metal oxide having a moisture content of less than 5 percent by weight of the total weight of the metal oxide, as well as, polyol and aminoplast resins, to improve image quality.

14 Claims, No Drawings

IMAGING MEMBER

RELATED APPLICATIONS

This application is a Continuation-in-part application of commonly assigned utility U.S. patent application Ser. No. 11/403,981 to Lin et al., entitled "Improved Imaging Member," filed on Apr. 13, 2006, now U.S. Publication No. 2007-0243476, published on Oct. 18, 2007. Reference is also made to copending, commonly assigned U.S. patent application Ser. No. 11/505,194 to Lin et al., entitled, "Improved Imaging Member," filed on Aug. 16, 2006, now U.S. Publication No. 2007-0243477, published on Oct. 18, 2007.

BACKGROUND

Herein disclosed are imaging members, such as layered photoreceptor devices, and processes for making and using the same. The imaging members can be used in electrophotographic, electrostatographic, xerographic and like devices, including printers, copiers, scanners, facsimiles, and including digital, image-on-image, and like devices. More particularly, the embodiments pertain to an imaging member or a photoreceptor that incorporates a metal oxide that possesses a moisture content of less than 5 percent by weight of the total weight of the metal oxide to improve image quality. Some embodiments further include other molecules, namely polyol and aminoplast resins, to improve image quality.

Electrophotographic imaging members, e.g., photoreceptors, typically include a photoconductive layer formed on an electrically conductive substrate. The photoconductive layer is an insulator in the substantial absence of light so that electric charges are retained on its surface. Upon exposure to light, the charge is dissipated.

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer.

The demand for improved print quality in xerographic reproduction is increasing, especially with the advent of color. Common print quality issues are strongly dependent on the quality of the undercoat layer (UCL). Conventional materials used for the undercoat or blocking layer have been problematic. In certain situations, a thicker undercoat is desirable, but the thickness of the material used for the undercoat layer is limited by the inefficient transport of the photoinjected electrons from the generator layer to the substrate. If the undercoat layer is too thin, then incomplete coverage of the substrate results due to wetting problems on localized unclean substrate surface areas. The incomplete coverage produces pin holes which can, in turn, produce print defects such as charge deficient spots (CDS) and bias charge roll (BCR) leakage breakdown. Other problems include "ghosting," which is thought to result from the accumulation of charge somewhere in the photoreceptor. Removing trapped electrons and holes residing in the imaging members is the key to preventing ghosting. During the exposure and development stages of xerographic cycles, the trapped electrons are mainly at or near the interface between charge generating layer (CGL) and undercoating layer (UCL) and holes mainly at or near the interface between charge generating layer and charge transport layer (CTL). The trapped charges can migrate according to the electric field during the transfer stage, where the electrons can move from the interface of CGL/UCL to CTL/CGL or the holes from CTL/CGL to CGL/UCL and became deep traps that are no longer mobile. Consequently, when a sequential image is printed, the accumulated charge results in image density changes in the current printed image that reveals the previously printed image. Thus, there is a need, which the present embodiments address, for a way to minimize or eliminate charge accumulation in photoreceptors, without sacrificing the desired thickness of the undercoat layer.

The terms "charge blocking layer" and "blocking layer" are generally used interchangeably with the phrase "undercoat layer."

Conventional photoreceptors and their materials are disclosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbaliu et al., U.S. Pat. No. 5,344,734; Terrell et al., U.S. Pat. No. 5,721,080; and Yoshihara, U.S. Pat. No. 5,017,449, which are herein all incorporated by reference.

More recent photoreceptors are disclosed in Fuller et al., U.S. Pat. No. 6,200,716; Maty et al., U.S. Pat. No. 6,180,309; and Dinh et al., U.S. Pat. No. 6,207,334, which are all herein incorporated by reference.

Conventional undercoat or charge blocking layers are also disclosed in U.S. Pat. No. 4,464,450; U.S. Pat. No. 5,449,573; U.S. Pat. No. 5,385,796; and Obinata et al, U.S. Pat. No. 5,928,824, which are all herein incorporated by reference.

SUMMARY

According to embodiments illustrated herein, there is provided a way in which print quality is improved, for example, ghosting is minimized or substantially eliminated in images printed in systems with high transfer current.

In particular, an embodiment provides an electrophotographic imaging member, comprising a substrate, an undercoat layer disposed on the substrate, wherein the undercoat layer comprises a metal oxide dispersed therein, the metal oxide being surface treated with sodium metaphosphate and having a moisture of less than 5 percent by weight of the total weight of the metal oxide, and at least one imaging layer formed on the undercoat layer.

Embodiments also provide an image forming apparatus for forming images on a recording medium comprising (a) an electrophotographic imaging member having a charge retentive-surface to receive an electrostatic latent image thereon, wherein the electrophotographic imaging member comprises a substrate, an undercoat layer disposed on the substrate, wherein the undercoat layer further comprises a polyol resin, an aminoplast resin, and a titanium oxide dispersed therein, the titanium oxide being surface treated with sodium metaphosphate and having a moisture of less than 5 percent by weight of the total weight of the metal oxide, and at least one imaging layer formed on the undercoat layer, (b) a development component adjacent to the charge-retentive surface for applying a developer material to the charge-retentive surface to develop the electrostatic latent image to form a developed image on the charge-retentive surface, (c) a transfer component adjacent to the charge-retentive surface for transferring the developed image from the charge-retentive surface to a copy substrate, and (d) a fusing component adjacent to the copy substrate for fusing the developed image to the copy substrate.

There is also provided a method for making an undercoat layer comprising admixing titanium oxide, polyol resin, and an aminoplast resin, the titanium oxide being surface treated with sodium metaphosphate and having a moisture of less than 5 percent by weight of the total weight of the metal oxide, coating the admixture on an imaging member, and curing the admixture to form the undercoat layer.

DETAILED DESCRIPTION

In the following description, it is understood that other embodiments may be utilized and structural and operational changes may be made without departure from the scope of the present embodiments disclosed herein.

The present embodiments relate to a photoreceptor having an undercoat layer which incorporates an additive to the formulation that helps reduce, and preferably substantially eliminates, specific printing defects in the print images.

According to embodiments, an electrophotographic imaging member is provided, which generally comprises at least a substrate layer, an undercoat layer, and an imaging layer. The undercoating layer is generally located between the substrate and the imaging layer, although additional layers may be present and located between these layers. The imaging member may also include a charge generating layer and a charge transport layer. This imaging member can be employed in the imaging process of electrophotography, where the surface of an electrophotographic plate, drum, belt or the like (imaging member or photoreceptor) containing a photoconductive insulating layer on a conductive layer is first uniformly electro statically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Thick undercoat layers are desirable for photoreceptors due to their life extension and charge leakage prevention. Furthermore, thicker undercoat layers make it possible to use less costly substrates in the photoreceptors. Such thick undercoat layers have been developed, such as one developed by Xerox Corporation and disclosed in U.S. patent application Ser. No. 10/942,277, filed Sep. 16, 2004, entitled "Photoconductive Imaging Members," which is hereby incorporated by reference. However, due to insufficient electron conductivity in dry and cold environments, the residual potential in conditions known as "J zone" (10% room humidity and 70° F.) is unacceptably high (e.g., >150V) when the undercoat layer is thicker than 15 μm.

Common print quality issues are strongly dependent on the quality of the undercoat layer. Conventional materials used for the undercoat or blocking layer have been problematic because print quality issues are strongly dependent on the quality of the undercoat layer. For example, charge deficient spots and bias charge roll leakage breakdown are problems the commonly occur. Another problem is "ghosting," which is thought to result from the accumulation of charge somewhere in the photoreceptor. Consequently, when a sequential image is printed, the accumulated charge results in image density changes in the current printed image that reveals the previously printed image.

There have been formulations developed for undercoat layers that, while suitable for their intended purpose, do not address the ghosting effect problem. To alleviate the problems associated with charge block layer thickness and high transfer currents, the incorporation of specific resins to a formulation containing titanium oxide ($TiO_2$) has shown to substantially reduce and preferably eliminate ghosting failure in xerographic reproductions. The addition of these resins, namely polyol and aminoplast resins, has shown to be useful in reducing ghosting.

In various embodiments, the polyol resin used is acrylic polyol resin. Other polyol resins that may be used are selected from, but are not limited to, the group consisting of polyglycol, polyglycerol and mixtures thereof. The aminoplast resin used with the embodiments may be selected from, but are not limited to, the group consisting of urea, melamine and mixtures thereof. In embodiments, a metal oxide is used, in combination with the resins, to form the undercoat layer formulation. The metal oxide is dispersed in the resins and the dispersion is subjected to heat. In embodiments, the metal oxide is has a size diameter of from about 5 to about 300 nm, a powder resistance of from about $1\times10^3$ to about $6\times10^4$ ohm/cm when applied at a pressure of from about 50 to about 650 kg/cm$^2$. In one embodiment, $TiO_2$ is used as the metal oxide in the undercoat layer formulation.

In embodiments, $TiO_2$ can be either surface treated or untreated. Surface treatments include, but are not limited to aluminum laurate, alumina, zirconia, silica, silane, methicone, dimethicone, sodium metaphosphate, and the like and mixtures thereof. Examples of $TiO_2$ include MT-150W (surface treatment with sodium metaphosphate, Tayca Corporation), STR-60N (no surface treatment, Sakai Chemical Industry Co., Ltd.), FTL-100 (no surface treatment, Ishihara Sangyo Laisha, Ltd.), STR-60 (surface treatment with Al203, Sakai Chemical Industry Co., Ltd.), TTO-55N (no surface treatment, Ishihara Sangyo Laisha, Ltd.), TTO-55A (surface treatment with Al203, Ishihara Sangyo Laisha, Ltd.), MT-150AW (no surface treatment, Tayca Corporation), MT-150A (no surface treatment, Tayca Corporation), MT-100S (surface treatment with aluminum laurate and alumina, Tayca Corporation), MT-100HD (surface treatment with zirconia and alumina, Tayca Corporation), MT-100SA (surface treatment with silica and alumina, Tayca Corporation), and the like.

It has been discovered that untreated titanium oxide provides good conductivity and compatibility with many classes of resin or polymeric binders. As a result, embodiments having incorporation of untreated titanium oxide into undercoat layers demonstrate excellent ghosting performance. In other embodiments, titanium oxide that is surface treated with, for example, sodium metaphosphate, also demonstrate excellent ghosting performance. Surface treatment provides better charge transport through the layer. However, titanium oxides that are surface treated are conductive and hydrophilic in nature, which induces high CDS. It appears that the moisture content on the titanium oxide particles is a source of the high CDS. By drying the titanium oxide under a vacuum at room temperature, the CDS is significantly reduced. Consequently, in embodiments of surface treated titanium oxide, the titanium oxide is additionally vacuum-dried. Undercoat formulations where the moisture content of the titanium oxide is below a certain threshold, such as 5 percent by weight of the total weight of the metal oxide, both low ghosting and low CDS is observed.

Other metal oxides that can be used with the embodiments include, but are not limited to, zinc oxide, tin oxide, aluminum oxide, silicon oxide, zirconium oxide, cerium oxide, indium oxide, molybdenum oxide, and mixtures thereof.

Undercoat layer binder materials are well known in the art. Typical undercoat layer binder materials include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like. Other examples of suitable undercoat layer binder materials include, but are not limited to, a polyamide such as Luckamide 5003 from DAINIPPON Ink and Chemicals, Nylon 8 with methylmethoxy pendant groups, CM 4000 and CM 8000 from Toray Industries Ltd and other N-methoxymethylated polyamides, such as those prepared according to the method described in Sorenson and Campbell "Preparative Methods of Polymer Chemistry" second edition, p. 76, John Wiley and Sons Inc. (1968), and the like and mixtures thereof. These polyamides can be alcohol soluble, for example, with polar functional groups, such as methoxy, ethoxy and hydroxy groups, pendant from the polymer backbone. Another examples of undercoat layer binder materials include phenolic-formaldehyde resin such as VARCUM 29159 from OXYCHEM, aminoplast-formaldehyde resin such as CYMEL resins from CYTEC, poly (vinyl butyral) such as BM-1 from Sekisui Chemical, and the like and mixtures thereof.

The weight/weight ratio of the polyol and aminoplast resins in the undercoat layer formulation is from about 5/95 to about 95/5, or from about 25/75 to about 75/25. The weight/weight ratio of the polyol and aminoplast resins to the titanium oxide in the undercoat layer formulation is from about 10/90 to about 90/10, or from about 30/70 to about 70/30. In embodiments, the aminoplast resin is present in an amount of from about 5% to about 80%, or from about 5% to about 75%, or from about 20% to about 80%, by weight of the total weight of the undercoat layer. In embodiments, the polyol resin is present in an amount of from about 5% to about 80%, or from about 5% to about 75%, or from about 20% to about 80%, by weight of the total weight of the undercoat layer. In embodiments, the $TiO_2$ is present in an amount of from about 10% to 90%, or from about 20% to about 80% by weight of the total weight of the undercoat layer.

The undercoat layer may also include a polymeric binder with the polyol resin, aminoplast resin and $TiO_2$ combination. The weight/weight ratio of the resins and $TiO_2$ combination and the binder is from about 20/80 to about 80/20, or from about 40/60 to about 65/35.

In various embodiments, the undercoat layer further contains an optional light scattering particle. In various embodiments, the light scattering particle has a refractive index different from the binder and has a number average particle size greater than about 0.8 μm. The light scattering particle can be amorphous silica or silicone ball. In various embodiments, the light scattering particle can be present in an amount of from about 0% to about 10% by weight of the total weight of the undercoat layer.

In various embodiments, the undercoat layer has a thickness of from about 0.1 μm to about 40 μm, or from about 2 μm to about 25 μm, or from about 10 μm to about 20 μm. In further embodiments, the resins/metal oxide combination is present in an amount of from about 20% to about 80%, or from about 40% to about 70%, by weight of the total weight of the undercoat layer.

A method for making an undercoat layer comprises admixing titanium oxide, polyol resin, and a melamine resin. The titanium oxide is surface treated with sodium metaphosphate and dried under vacuum at room temperature. After mixing, the composition is coated onto an imaging member. Once the imaging member is coated the layer is cured to form the undercoat layer.

The undercoat layer may be applied or coated onto a substrate by any suitable technique known in the art, such as spraying, dip coating, draw bar coating, gravure coating, silk screening, air knife coating, reverse roll coating, vacuum deposition, chemical treatment and the like. Additional vacuuming, heating, drying and the like, may be used to remove any solvent remaining after the application or coating to form the undercoat layer.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

EXAMPLES

The examples set forth herein below and are illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Comparative Example I

A conventional undercoat layer dispersion, known as UC79, was prepared as follows: In a 4 oz. glass bottle, 16.7 g of $TiO_2$ (MT-150W, Tayca Co., Japan) and 5.2 g of phenolic resin (Varcum 29159, Oxychem Co.) and 5.3 g of a melamine resin (Cymel 323, Cytec Co.) were mixed with 15 g of xylene and 15 g of n-butanol. After mixing, 120 g of 0.4-0.6 mm diameter zirconium oxide beads were added and roll milled for overnight. The reference device was prepared by coating a device with the undercoat layer dispersion at 5 μm at a curing condition of 140 C/30 min. Subsequently, a 0.2-0.5 μm charge generating layer comprised of chlorophthalocyaninne and a 29 μm charge transport layer comprised of N,N'-bis (methylphenyl)-1,1-biphenyl-4,4'-diamine, a polycarbonate, and polytetrafluoroethylene (PTFE) particles were coated.

Comparative Example II

A conventional undercoat layer dispersion, as described above, was prepared. The reference device was prepared by coating a conventional three-component device with the undercoat layer dispersion at 5 μm at a curing condition of 140 C/30 min. Subsequently, a 0.2-0.5 μm charge generating layer comprised of chlorophthalocyaninne and a 29 μm charge transport layer comprised of N,N'-bis(methylphenyl)-1,1-biphenyl-4,4'-diamine, a polycarbonate, and PTFE particles were coated.

Example I

An undercoat layer dispersion was prepared as follows: preparation of the undercoating layer dispersion was done by mixing 18.5 gm of titanium oxide (MT-150W, Tayca Co., Japan), 6.25 gm of Cymel 323 melamine resin (Cytec Co.), 6.0 gm of Paraloid AT-400 acrylic polyol resin (Rohm Haas), and 32 gm of methylethyl ketone (MEK) in a 4 oz. glass bottle. After mixing, 140 gm of 0.4-0.6 mm $ZrO_2$ beads were added and roll milled for two days. The final dispersion was collected through a 20 gm Nylon filter and the final solid percentage was measured to be 42.5%. An experimental device was prepared by coating the new undercoat layer at 5 μm at a curing condition of 140 C/30 min. Subsequently, a 0.2-0.5 μm charge generating layer comprised of chlorophthalocyaninne and a 29 μm charge transport layer comprised of N,N'-bis(methylphenyl)-1,1-biphenyl-4,4'-diamine, a polycarbonate, and PTFE particles were coated.

Results

The device with the inventive undercoat layer of Example I was tested against the above comparative devices in a scanner set to obtain photo-induced discharge characteristic (PIDC) curves, sequenced at one charge-erase cycle followed by one charge-expose-erase cycle, wherein the light intensity was incrementally increased with cycling to produce a series of PIDC curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of about 500 and about 700 volts with the exposure light intensity incrementally increased by means of regulating a series of neutral density filters. The exposure light source was a 780-nanometer light emitting diode. The aluminum drum was rotated at a speed of about 61 revolutions per minute to produce a surface speed of about 122 millimeters per second. The xerographic simulation was completed in an environmentally controlled light tight chamber at ambient conditions (about 50% relative humidity and about 22° C.).

Very similar PIDC curves were observed for both photoreceptor devices, thus the new undercoat layer, containing the polyol and melamine resins, performs very similarly to a conventional undercoat layer from the point of view of PIDC. The experimental device showed normal electrical propertied with similar residual voltage and charge acceptance to that of reference device. The Vdep, Vlow, dV/dX, Verase, and dark decay all suggest the new undercoat layer is functioning properly.

The above photoreceptor drums were then acclimated for 24 hours before testing J-zone conditions (70 F/10% RH) in a Copeland Work centre Pro 3545 machine using K station at t=0 and t=500 print count. Run-ups from t=0 to t=500 prints for all devices were done in one of the CYM color stations. Ghosting levels were measured against an internal visual standard, with a rating of grades 1-5 (G1-G5) (the highest grade being the worst).

Example II

Another inventive undercoat layer comprises a surface treated and vacuum dried metal oxide (available from MT-150W, Tayca Co., Japan), polyol resin, and a melamine resin.

The inventive undercoat layer dispersion was prepared as follows: preparation of the undercoating layer dispersion was done by mixing 18.7 gm of the dried titanium oxide, 6.25 gm of Cymel 323 melamine resin (Cytec Co.), 6.0 gm of Paraloid AT400 acrylic polyol resin (Rohm and Haas), and 26.9 gm of methylethyl ketone (MEK) for a pigment to binder weight ratio of 62/38 and a binder to binder ratio of 50/50 in a 4 oz. glass bottle. And after mixing, 130 gm of 0.4-0.6 mm $ZrO_2$ beads were added and roll milled for 24 hours at a bottle speed of 100 rpm. The final dispersion was collected through a 20 μm Nylon filter and the final solid percentage was measured to be 45.7%. An inventive device was prepared by coating the new UCL at 5 μm at a curing condition of 145 C/30 min. Subsequently, a 0.2-0.5 μm charge generating layer comprised of chlorophthalocyaninne and a 30 μm charge transport layer (CTL) comprised of N,N'-bis(methylphenyl)-1,1-biphenyl-4,4'-diamine, a polycarbonate, and PTFE particles were coated.

Results

The above prepared photoreceptor device of Example II was tested in comparison to the conventional devices and the inventive device showed normal electrical properties with similar residual voltage and charge acceptance to that of reference device. The Vdep, Vlow, dV/dX, Verase, and dark decay all suggest the new undercoat layer is functioning properly. See Table 1 for the electrical comparison results of the device having surface treated titanium oxide which has been vacuum dried.

The above devices were then acclimated for 24 hours before testing J-zone conditions (70 F/10% RH) and A Zone (80 F/80% RH) in a Work Centre Pro 3545 machine using K station at t=0 and t=500 print count. Run-ups from t=0 to t=500 prints for all devices were done in one of the CYM color stations. Ghosting levels were measured against an internal visual standard, with a rating of grades 1-5 (G1-G5) (the highest grade the worst). A Zone CDS print test was also conducted in the Work centre Pro 3545 using K station at t=0 print count. See Table 1 for the ghosting comparison results of the device having surface treated titanium oxide which has been vacuum dried to a moisture content of less than 5% in weight to the total weight of titanium oxide.

The ghosting tests revealed that the untreated titanium oxide (MT-150AW) gave similar but more robust ghosting performance than that of the sodium metaphosphate treated titanium oxide (MT-150W). Table 1 shows a summary of ghost results for experimental devices with UCL containing MT-150AW titanium oxide and reference devices with the original MT-150W containing UCL, where the MT-150AW containing UCL has ghosting levels of G1 at t=0 and G1.5 at t=500, and the results were confirmed twice, in contrast the MT-150W based UCL has ghosting performance varies from G1 to G3.5, under the presumably same preparation conditions with the same materials. The MT-150AW containing UCL also has a huge advantage in CDS performance, as the titanium oxide contains no surface treatment and appears to be less likely to induce hole injection from the substrate and be itself a source of free carriers. The CDS grade is G2.5 at 165 mm/S process speed when tested on a 15 um CTL thin device, in contrast, usually the CDS level for the UCL formulated with MT-150W is G4-5 for similar device configuration, at least 2 grades worse than UCL comprises of MT-150AW.

TABLE 1

Electrical, J Zone Ghosting and A Zone CDS Print Test Results

| Device | dV/dX | Vearse | Dark Decay | J zone Ghost t = 0 | J zone Ghost t = 500 | A Zone CDS (165 mm/S) |
|---|---|---|---|---|---|---|
| MT-150AW UCL (29 um CTL) | −224 | 20 | 9 | G1 | G1.5 | |
| MT-150W UCL (30 um CTL) | −217 | 37 | 12 | G0-2 | G1-4* | |
| MT-150AW UCL (15 um CTL) | | | | | | 2.5 |
| MT-150W UCL (15 um CTL) | | | | | | 5 |

In addition, the moisture content of the inventive devices having the vacuum-dried surface treated titanium oxide were analyzed against the devices in which the surface treated titanium oxide were not dried. The results are shown in Table 2. As can be seen, the vacuum-dried embodiments had a moisture content below the 4 percent threshold.

TABLE 2

Moisture content of MT-150W titanium oxide particles

| Sample Batch ID | Moisture Content (%) |
|---|---|
| TiO2 MT-150W/ lot#1 Dried | 3.93* |
| TiO2 MT-150W/ lot#2 Dried | 3.54* |
| TiO2 MT-150W/ lot#1 As-is | 4.66 |
| TiO2 MT-150W/ lot#2 As-is | 4.67 |

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. An electrophotographic imaging member, comprising:

a substrate;

an undercoat layer disposed on the substrate, wherein the undercoat layer comprises:

a metal oxide dispersed therein, the metal oxide being surface treated with sodium metaphosphate and having a moisture content of less than 5 percent by weight of the total weight of the metal oxide;

a polyol resin selected from the group consisting of acrylic polyols, polyglycerols and mixtures thereof; and an aminoplast resin; and at least one imaging layer formed on the undercoat layer;

wherein the polyol resin is present in an amount of from about 5% to about 80% by weight of the total weight of the undercoat layer; and wherein the metal oxide is present in an amount of from about 10% to about 90% by weight of the total weight of the undercoat layer.

2. The electrophotographic imaging member of claim 1, wherein the metal oxide is selected from the group consisting of titanium oxide, zinc oxide, zirconium oxide, cerium oxide, and mixtures thereof.

3. The electrophotographic imaging member of claim 1, wherein the aminoplast resin is selected from the group consisting of melamine-formaldehyde resin, urea-formaldehyde resin and mixtures thereof.

4. The electrophotographic imaging member of claim 3, wherein the aminoplast resin is present in an amount of from about 5% to about 80% by weight of the total weight of the undercoat layer.

5. The electrophotographic imaging member of claim 1, wherein thickness of the undercoat layer is from about 0.1 μm to about 40 μm.

6. An image forming apparatus for forming images on a recording medium comprising:

a) an electrophotographic imaging member having a charge retentive-surface to receive an electrostatic latent image thereon, wherein the electrophotographic imaging member comprises:

a substrate;

an undercoat layer disposed on the substrate, wherein the undercoat layer further comprises:

a polyol resin selected from the group consisting of acrylic polyols, polyglycerols and mixtures thereof;

an aminoplast resin; and a titanium oxide dispersed therein, the titanium oxide being surface treated with sodium metaphosphate and having a moisture content of less than 5 percent by weight of the total weight of the metal oxide; and wherein the polyol resin is present in an amount of from about 5% to about 80% by weight of the total weight of the undercoat layer;

and wherein the metal oxide is present in an amount of from about 10% to about 90% by weight of the total weight of the undercoat layer; and at least one imaging layer formed on the undercoat layer;

b) a development component adjacent to the charge-retentive surface for applying a developer material to the charge-retentive surface to develop the electrostatic latent image to form a developed image on the charge-retentive surface;

c) a transfer component adjacent to the charge-retentive surface for transferring the developed image from the charge-retentive surface to a copy substrate; and d) a fusing component adjacent to the copy substrate for fusing the developed image to the copy substrate.

7. The image forming apparatus of claim 6, wherein the aminoplast resins are selected from the group consisting of melamine-formaldehyde resin, urea-formaldehyde resin and mixtures thereof.

8. The image forming apparatus of claim 6, wherein the polyol resin is present in an amount of from about 20% to about 80% by weight of the total weight of the undercoat layer.

9. The image forming apparatus of claim 6, wherein the aminoplast resin is present in an amount of from about 20% to about 80% by weight of the total weight of the undercoat layer.

10. The image forming apparatus of claim 6, wherein the titanium oxide is present in an amount of from about 20% to about 80% by weight of the total weight of the undercoat layer.

11. A method for making an undercoat layer of an imaging member, comprising the steps of:

admixing titanium oxide, polyol resin, and an aminoplast resin, the titanium oxide being surface treated with sodium metaphosphate and having a moisture content of less than 5 percent by weight of the total weight of the metal oxide;

coating the admixture onto a substrate; and curing the admixture to form the undercoat layer;

coating at least one imaging layer onto the undercoat layer;

wherein the undercoat layer is formed on the substrate with at least one imaging layer form on the undercoat layer; and wherein the polyol resin is selected from the group consisting of acrylic polyols, polyglycerols and mixtures thereof;

wherein the polyol resin is present in an amount of from about 5% to about 80% by weight of the total weight of the undercoat layer;

and wherein the metal oxide is present in an amount of from about 10% to about 90% by weight of the total weight of the undercoat layer.

12. The method of claim 11, wherein the aminoplast resins are selected from the group consisting of melamine-formaldehyde resin, urea-formaldehyde resin and mixtures thereof.

13. The method of claim 11, wherein thickness of the formed undercoat layer is from about 0.1 μm to about 40 μm.

14. The method of claim 11, wherein the aminoplast resin is present in an amount of from about 5% to about 80% by weight of the total weight of the formed undercoat layer.

* * * * *